US006023519A

United States Patent [19]

Tajima et al.

[11] Patent Number: 6,023,519

[45] Date of Patent: Feb. 8, 2000

[54] ELECTROACOUSTIC TRANSDUCER

[75] Inventors: Kazushige Tajima; Yoshio Imahori; Takahiro Sone; Isao Fushimi, all of Shizuoka, Japan

[73] Assignee: Star Micronics Co., Ltd., Shizuoka, Japan

[21] Appl. No.: 08/968,501

[22] Filed: Nov. 12, 1997

[30] Foreign Application Priority Data

Nov. 20, 1996 [JP] Japan ..... 8-309415

[51] Int. Cl.[7] ..... H04R 25/00

[52] U.S. Cl. ..... 381/412; 381/417; 381/396

[58] Field of Search ..... 381/192, 194, 381/199, 202, 200, 193, 191, 396, 398, 412, 414, 417, 420, 152, 153, 159, 160; 29/594, 609.1

[56] References Cited

U.S. PATENT DOCUMENTS 4,504,703 3/1985 Schneiter et al. ..... 381/191

5,432,758 7/1995 Sone ..... 381/193

*Primary Examiner*—Huyen Le

*Attorney, Agent, or Firm*—Pollock, Vande Sande & Amernick

[57] ABSTRACT

The invention provides an electroacoustic transducer capable of preventing degradation in its acoustic performance as a result of the reflow soldering process applied. With the electroacoustic transducer, variation in the minimum resonance frequency Fo of a diaphragm is restrained, stabilizing the acoustic performance by causing a decrease in the minimum resonance frequency Fo of the diaphragm due to irreversible demagnetization of the magnet caused by the reflow soldering temperatures to cancel out an increase in the minimum resonance frequency Fo of the diaphragm due to thermal contraction of a holder member caused by the reflow soldering temperatures.

11 Claims, 14 Drawing Sheets

TEST PIECE : 120×120 ×3 mm
GATE : 120×2 mm Film Gate
ANNEALING CONDITION : 200 ℃, 3 hours
DIRECTION : // DIRECTION OF FLOW, ⊥ AT RIGHT ANGLE

AIR GAP VARIATION AFTER REFLOW

ELECTROACOUSTIC TRANSDUCER

BACKGROUND OF THE INVENTION

1. Field of the Invention

The present invention relates to an electroacoustic transducer for use in a sounder and the like for converting electric signals into sound through electromagnetic conversion.

2. Description of the Related Art

FIGS. 13 and 14 illustrate a conventional electroacoustic transducer. The electroacoustic transducer is provided with a casing 100 formed of a synthetic resin, inside which a holder member 102 made of a non-magnetic material or the equivalent is securely held, and a diaphragm 104 prepared from a magnetic material in a plate form is installed on the upper surface of the holder member 102. A magnetic piece 106 is attached to the diaphragm 104. A resonance chamber 108 is formed on the upper side of the diaphragm 104 with the casing 100 surrounding it, and exposed to the air via a sound emitting hole opened on the casing 100. On the back side of the diaphragm 104, a base 112 and a printed circuit board 114 are installed, closing the back of the casing 100. A magnetic core 116 is installed at the center of the base 112, and wound around with a coil 118. Further a magnet 120 is installed around and spaced apart from the coil 118. An air gap 122 is provided between the top end of the magnetic core 116 and the diaphragm 104, and terminals of the coil 118 wound around the magnetic core 116 are connected to base parts of terminal pins 124 and 126, respectively by means of soldering. The terminal pins 124 and 126 are securely attached to the printed circuit board 114 by clamping the base parts thereof.

Meanwhile, since the electroacoustic transducer described is electrically connected by means of the reflow soldering process to printed circuit boards of various electronic equipment requiring emission of sound, it is heated up at the time of applying the soldering process. Accordingly, a countermeasure for enhancing heat-resistance of relevant components, and preventing degradation in acoustic performance of the equipment is implemented in order to protect the electroacoustic transducer from thermal degradation due to such a heat treatment. Use of heat-resistant components, however, create a cause for an increase in manufacturing costs of the electroacoustic transducer.

A problem with the countermeasure for enhancing heat resistance of the electroacoustic transducer is how to ensure heat resistance of the magnet 120 and the holder member 102, affecting most the characteristic of a magnetic circuit. In particular, heat resistance of the holder member 102 is essential to keep the air gap 122 constant because thermal deformation of the holder member 102 has an effect on a spread of the air gap 122 between the diaphragm 104 and the magnetic core 116.

The magnet 120 undergoes reversible demagnetization at a temperature on the order of 80° C., which is an operating temperature for a sounder, but does not undergo irreversible demagnetization. Therefore, it can restore magnetic force at room temperature. Temperatures at which the reflow soldering is applied are high ranging from 200 to 250° C., and when the magnet 120 is subjected to such high temperatures, irreversible demagnetization occurs, resulting in reduction of magnetic force by about 5 to 30% after it is cooled down to room temperature. It is well known that a degree of such demagnetization varies widely depending on a grade of a material forming the magnet 120, and in general, the smaller a degree of demagnetization is, the higher the cost of a material having such property. That is, the cost of a material having excellent heat resistance tends to rise correspondingly.

FIG. 15 illustrates a profile of the reflow soldering temperatures by way of example. In this case, temperatures measured indicate those at the center of a standard printed circuit board of an electronic equipment. It is shown clearly from the profile that the electroacoustic transducer mounted on the board is subjected to substantial heating, and hence, demagnetization of the magnet 120 is not negligible.

Such demagnetization causes magnetic attraction between the diaphragm 104 and the magnetic core 116 to be decreased, affecting acoustic performance of the electroacoustic transducer. FIG. 16 shows frequency characteristic (acoustic characteristic) of sound pressure prior to the reflow soldering, FIG. 17 frequency characteristic (acoustic characteristic) of sound pressure after the reflow soldering, FIG. 18 frequency characteristic (acoustic characteristic) of electric current prior to the reflow soldering, and FIG. 19 frequency characteristic (acoustic characteristic) of electric current after the reflow soldering. That is, in the case of the electroacoustic transducer subjected to heating during the reflow soldering, a minimum resonance frequency Fo of the diaphragm 104 is decreased, and sound pressure levels also become lower, degrading the acoustic characteristic thereof.

The holder member 102 is formed of a non-magnetic metal, resin, or the like. The holder member 102 formed of such materials undergoes elongation at a temperature in the order of 80° C. according to the linear expansion coefficient of the respective materials, however, restores its initial dimensions at room temperature. By applying temperatures for the reflow soldering, however, the holder member 102 formed of a resin undergoes dimensional contraction due to annealing effect or thermal degradation. FIG. 20 shows contraction ratios of LCP materials. A degree of such contraction varies widely depending on the grade of the respective matierals, and in general, the lower a contraction ratio is, the higher the cost of a matieral having such property.

Contraction of the holder member 102 due to heating during the reflow soldering causes the air gap 122 between the magnetic core 116 and the diaphragm 104 to be narrowed to an extent of the contraction, and magentic attraction bdtween the diaphragm 104 and the magnetic core 116 is strengthened accordingly. Table 1 shows the relationship between materials compsoing the holder member and variation in the air gap spread, and Fig. 21 shows variation in the ari gap spread following the reflow soldering.

TABLE 1

Results of Survey on Variation in the Air Gap before and after Reflow Soldering

| model | molding material | initial | after reflow soldering | variation | air gap (unit: $\mu$m) | |
|---|---|---|---|---|---|---|
| A | VECTRA | 191 | 191 | 0 | | |
| " | | 192 | 192 | 0 | | |
| " | | 193 | 193 | 0 | | |
| " | | 191 | 191 | 0 | AVE. | 0.0 |
| " | | 188 | 188 | 0 | δn − 1 | — |
| " | XREC | 189 | 186 | −3 | | |
| " | | 188 | 187 | −1 | | |
| " | | 192 | 192 | 0 | | |
| " | | 187 | 184 | −3 | AVE. | −2.0 |
| " | | 186 | 183 | −3 | δn − 1 | 1.41 |
| " | AMODEL | 190 | 188 | −2 | | |
| " | | 190 | 189 | −1 | | |
| " | | 195 | 193 | −2 | | |
| " | | 189 | 186 | −3 | AVE. | −2.2 |
| " | | 193 | 190 | −3 | δn − 1 | 0.84 |
| B | VECTRA | 163 | 160 | −3 | | |

TABLE 1-continued

Results of Survey on Variation in the Air Gap before and after Reflow Soldering

| model | molding material | initial | after reflow soldering | variation | air gap (unit: μm) | |
|---|---|---|---|---|---|---|
| " | | 155 | 150 | −5 | | |
| " | | 133 | 114 | −19 | | |
| " | | 152 | 154 | 2 | AVE. | −5.8 |
| " | | 164 | 160 | −4 | δn − 1 | 7.85 |

In order to avoid adverse effects as described above of the reflow soldering temperatures, a magnet having a low ratio of irreversible demagnetization has been used for the magnet 120, and a resin, metal or the equivalent having a low contraction ratio has been used for the holder member 102. Such a practice, however, has created a problem of an increase in the costs of components of the electroacoustic transducer.

SUMMARY OF THE INVENTION

It is therefore an object of the present invention to provide an electroacoustic transducer capable of preventing degradation in acoustic performance caused by the reflow soldering process.

As illustrated in FIGS. 1 to 12, with the electroacoustic transducer according to the invention, a decrease in the minimum resonance frequency Fo of a diaphragm 22 due to demagnetization of a magnet 10 is caused to cancel out an increase in the minimum resonance frequency Fo of the diaphragm 22 due to thermal contraction of a holder member 20 to achieve the above object, taking advantage of demagnetization characteristic of the magnet 10 whereby irreversible demagnetization occurs to the magnet by the reflow soldering temperatures, and contraction characteristic of the holder member 20 whereby contraction thereof occurs by the reflow soldering temperatures so that variation in the minimum resonance frequency Fo of the diaphragm 22 is restrained, stabilizing the acoustic performance of the electroacoustic transducer.

The electroacoustic transducer comprises a magnetic core 16 wound around with a coil 18, a diaphragm 22 vibrated when subjected to an alternating magnetic field produced by the magnetic core, a holder member 20 supporting the diaphragm such that an air gap 24 is provided between the diaphragm and the magnetic core, and the magnet 10 provided inside the holder member for causing a magnetic field to act on the diaphragm so that electric signals supplied to the coil are converted into sound by converting the electric signals into the alternating magnetic field which is caused to act on the diaphragm, the magnet being formed of a magnetic material causing irreversible demagnetization by temperatures for the reflow soldering process while the holder member being formed of a material contracting by the temperatures for the reflow soldering process.

With the electroacoustic transducer constituted as above, it is possible to cause the decrease in the minimum resonance frequency Fo of the diaphragm due to demagnetization of the magnet to cancel out the increase in the minimum resonance frequency Fo of the diaphragm due to thermal contraction of the holder member, restraining variation in the minimum resonance frequency Fo of the diaphragm so that the acoustic performance is stabilized.

In the electroacoustic transducer, the magnet is formed of a samarium—cobalt based magnetic material, or neodymium based magnetic material. Use of such magnetic materials for the magnet enables irreversible demagnetization caused by heat generated at the temperatures for the reflow soldering process to balance with thermal contraction occurring to the holder member.

In the electroacoustic transducer as set forth in claim 3, the holder member is formed of a synthetic resin. Use of such a resin material for the holder member enables thermal contraction by the reflow soldering temperatures to balance with demagnetization of the magnet.

The temperatures for the reflow soldering process are within the range of 200 to 250° C. Normally, the reflow soldering process is applied at a temperature from 200 to 250° C. At a temperature in this range, the decrease in the minimum resonance frequency Fo of the diaphragm due to demagnetization of the magnet is caused to cancel out the increase in the minimum resonance frequency Fo of the diaphragm due to thermal contraction of the holder member, restraining variation in the minimum resonance frequency Fo of the diaphragm.

The above and other objects, features, advantages, and the like of the invention will become more apparent by referring to the following detailed description and appended drawings with respect to preferred embodiments of the invention and examples.

DETAILED DESCRIPTION OF THE PREFERRED EMBODIMENTS

Figure 1:
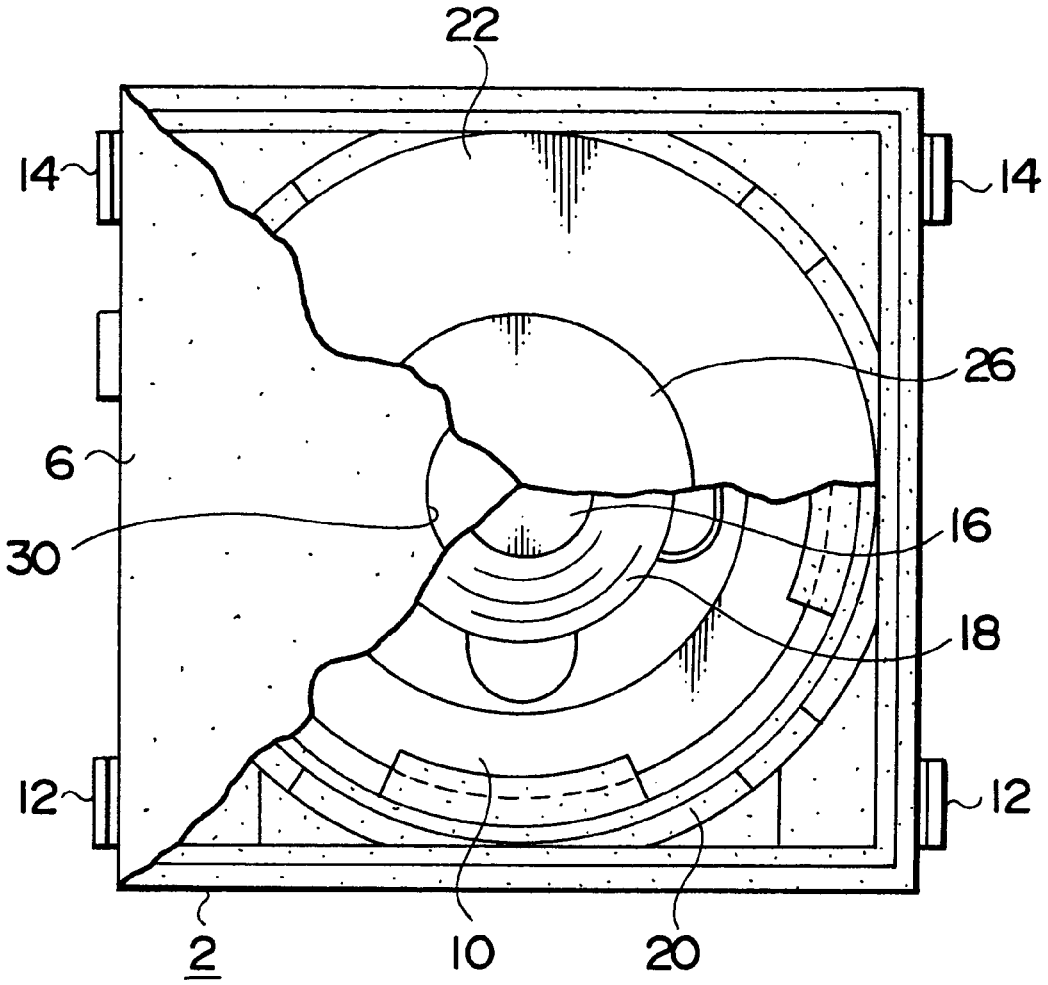
FIG. 1 is a partially cutaway plan view of an electroacoustic transducer according to an embodiment of the invention.
Figure 2:
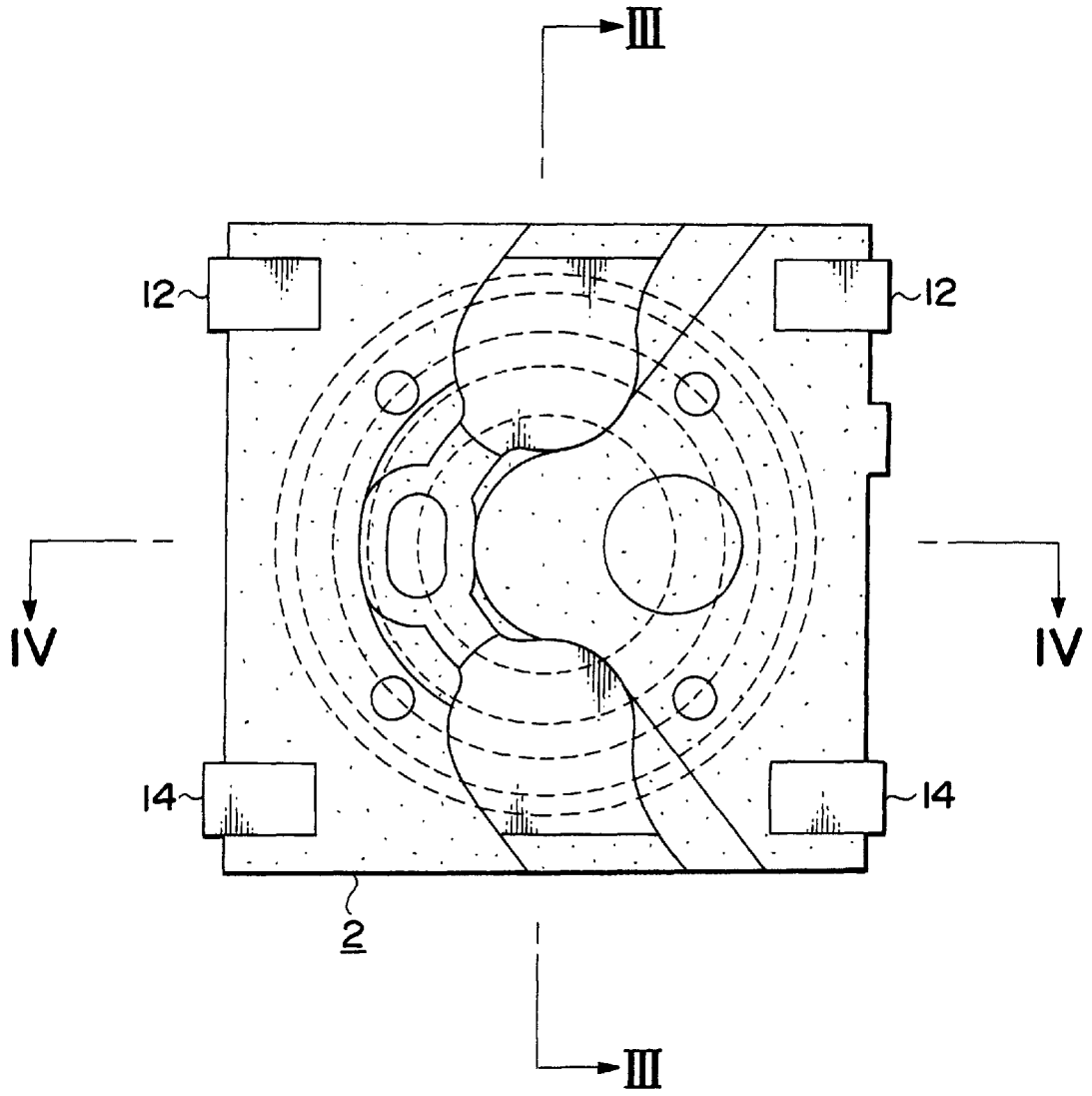
FIG. 2 is a bottom view of the electroacoustic transducer shown in FIG. 1.
Figure 3:
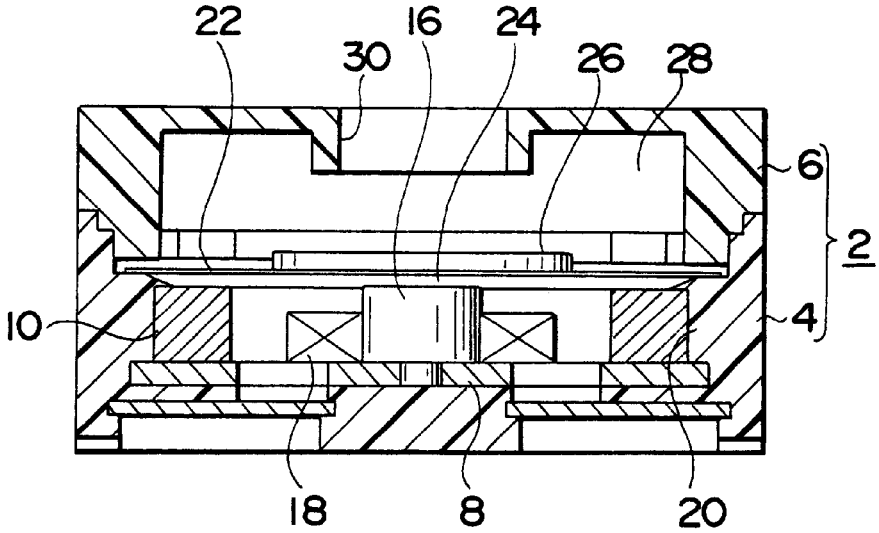
FIG. 3 is a sectional view of the electroacoustic transducer, taken on line III—III in FIG. 2.
Figure 4:
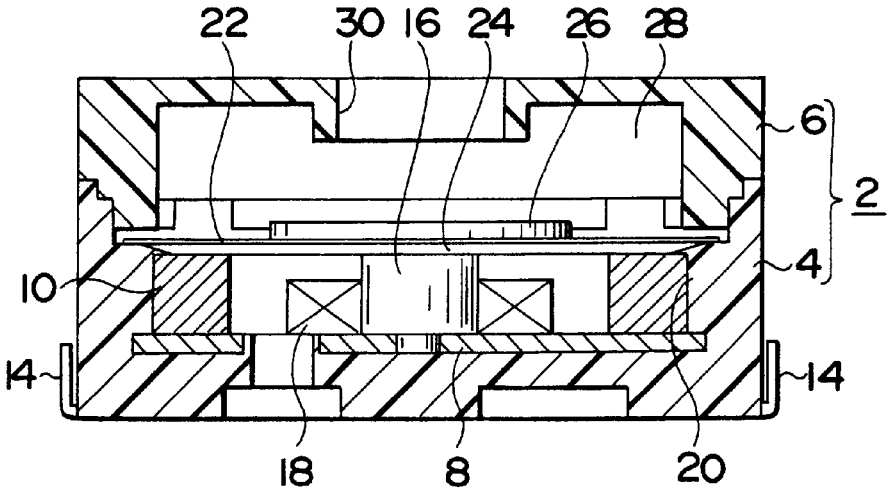
FIG. 4 is a sectional view of the electroacoustic transducer, taken on line IV—IV in FIG. 2.

Referring to the accompanying drawings, an electroacoustic transducer according to embodiments of the invention is described in detail hereinafter.

FIGS. 1 to 4 show the electroacoustic transducer according to an embodiment of the invention. Fig. is a partially cutaway plan view of the electroacoustic transducer, FIG. 2 a bottom view thereof, FIG. 3 a sectional view taken on line III—III in FIG. 2, and FIG. 4 a sectional view taken on line IV—IV in FIG. 2.

A casing 2 is composed of two cases 4 and 6, each rectangular in shape, both of which are formed by molding a synthetic resin, and joined integrally with each other by means of the ultrasonic welding or the like. The case 4 may be formed by various molding methods, and for example, as a base member on a lead frame. In this embodiment, the case 4 is formed as the base member, and a base 8, a magnet 10, and lead terminals 12 and 14 are insert-molded.

The base 8 is a metal plate made of a magnetic material, and in the shape of a flat plate. The base 8 is integrally provided with a magnetic core 16, columnar in shape and set up upright at the center of the base 8, and a coil 18 is wound around the magnetic core 16. The magnet 10 annular in shape is disposed in such a way as to surround the coil 18. The bottom face of the magnet 10 is kept in absolute contact with the surface of the base 8. Terminals of the coil 18 are electrically connected to the lead terminals 12 and 14, respectively, by means of soldering or the like. When electric signals are applied to the lead terminals 12 and 14, exciting current corresponding to the electric signals is caused to flow in the coil 18, resulting in generation of an alternating magnetic field in the magnetic core 16, corresponding to frequency of the electric signals.

The magnetic core 16 and the magnet 10 are concentrically disposed, and positioning of the magnet 10 is constrained by the holder member 20 formed inside the case 4. The holder member may be composed of a member different from same for the case 4, however, in this embodiment, is formed integrally with the case 4. Accordingly, the holder member is composed of a synthetic resin same as that used for the case 4. In the case of the holder member 20 being formed from the different member, a resin different from that used for the case 4 may be selected. Even, in such a case, the holder member 20 may be formed integrally with the case 4 by means of insert-molding.

The diaphragm 22 is provided on the holder member 20. The diaphragm 22, serving as a vibrating member, is composed of a magnetic material so as to be responsive to a magnetic force of the magnetic core 16. Between the diaphragm 22 and the magnetic core 16, an air gap 24 is formed, and a spread thereof is determined by a difference in height between the holder member 20 and the magnetic core 16. The air gap 24 having a desired spread is formed by rendering the height of the holder member 20 higher than that of the magnetic core 16.

The alternating magnetic field produced by the magnetic core 16 acts on the diaphragm 22 via the air gap 24 while a magnetic field caused by the magnet 10, forming a closed magnetic path with the diaphragm 22, is caused to act on the diaphragm 22 with the result that the diaphragm 22 is caused to vibrate up and down by the alternating magnetic field. Further, a magnet piece 16 is attached on the center of the diaphragm 22 as a means for increasing a vibrating mass.

A resonance chamber 28, serving as a resonance space, is formed on the upper side of the diaphragm 22, and covered by the case 6. The resonance chamber 28 is open to the air via a sound emitting hole 30 opened on the case 6. Sound generated by vibration of the diaphragm 22 resonates with the resonance chamber 28, and is emitted to the air mainly through the sound emitting hole 30.

In the electroacoustic transducer described in the foregoing, the magnet 10 is formed of a magnetic material causing irreversible demagnetization by temperatures for the reflow soldering process, in the range of 200 to 250° C. Such materials are enumerated below by way of example:

i. isotropic samarium-cobalt sinter 1–5 series ii. isotropic samarium-cobalt sinter 2–17 series iii. neodymium based bond iv. samarium based bond In the electroacoustic transducer described above, the holder member 20 is formed of a synthetic resin contracting by temperatures for the reflow soldering process, in the range of 200 to 250° C. In the case of this embodiment, the holder member 20 is formed integrally with the case 4 as the base member, and hence, the casing 2 itself is formed of such a synthetic resin. Such synthetic resins are enumerated below by way of example:

a. LCP -1, VECTRA E130i b. LCP- 2, VECTRA E130i c. Nylon 6T, ARLEN 230 d. PPS, C -100 HG

The materials described above composing the magnet 10 and the holder member, respectively, may be combined at option, and it is possible to select the most optimum combination of the materials for restraining fluctuation in the minimum resonance frequency Fo of the diaphragm 22.

With the electroacoustic transducer constituted as above, when the magnet 10 is subjected to heating at the reflow soldering temperatures, magnetic attraction between the diaphragm 22 and the magnetic core 16 is diminished due to irreversible demagnetization occurring to the magnet 10, affecting acoustic characteristic. In particular, sound pressure is reduced due to fluctuation in the minimum resonance frequency Fo of the diaphragm 22, usually a value thereof being lowered, affecting acoustic characteristic significantly.

Meanwhile, when the holder member 20 is subjected to heating at the reflow soldering temperatures, the spread of the air gap 24 is diminished due to thermal contraction of the holder member 20. The magnetic attraction between the diaphragm 22 and the magnetic core 16 is enhanced due to the narrowed spread of the air gap 24, causing the minimum resonance frequency Fo of the diaphragm 22 to become higher. That is, acoustic characteristic is significantly affected. This effect is in reverse relationship with that of demagnetization of the magnet 10.

Accordingly, owing to a combination effect of the materials forming the magnet 10 and the holder member 20, respectively, whereby a decrease in the minimum resonance frequency Fo caused by demagnetization occurring to the magnet 10 cancels out an increase in the minimum resonance frequency Fo caused by thermal contraction occurring to the holder member 20, complementing each other, desirable results are obtained that no fluctuation in the minimum resonance frequency Fo occurs even when the magnet 10 and the holder member 20 are exposed to heating at the reflow soldering temperatures.

Embodiments

The electroacoustic transducer according to the embodiment of the invention as illustrated in FIGS. 1 to 4 is described below.

Figure 5:
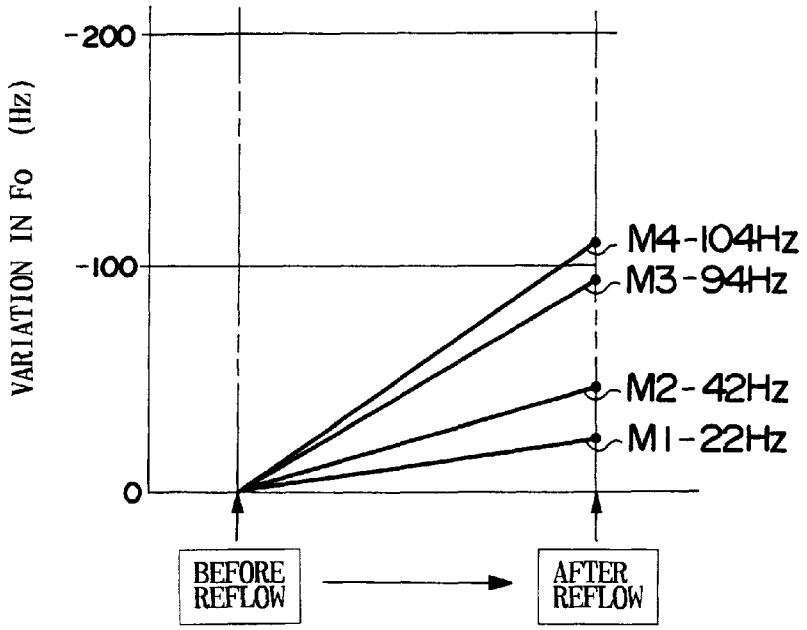
FIG. 5 is a graph showing variation characteristic of the minimum resonance frequency due to variation in total magnetic fluxes before and after the reflow soldering process with respect to the electroacoustic transducer according to embodiments of the invention.

FIG. 5 shows variation in the minimum resonance frequency Fo of the diaphragm 22 between times before and after the reflow soldering in the cases of various materials being used for the magnet 10. In FIG. 5, M1 denotes a characteristic in the case of using isotropic samarium-cobalt sinter 1–5 series for the magnet 10, M2 for the case of isotropic samarium-cobalt sinter 2–17 series, M3 for the case of neodymium based bond, and M4 for the case of samarium based bond. A value of variation in the minimum resonance frequency Fo as a result of heating at the reflow soldering temperatures is found to be 22 Hz less in the case of M1, 42 Hz less in the case of M2, 94 Hz less in the case of M3, and 104 Hz less in the case of M4.

Figure 6:
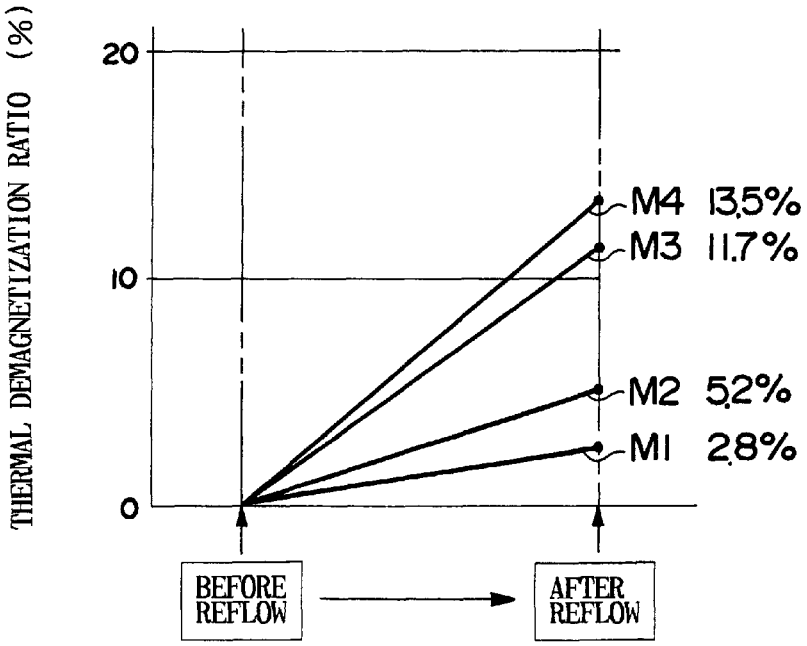
FIG. 6 is a graph showing thermal demagnetization ratios before and after the reflow soldering process with respect to the electroacoustic transducer according to the embodiments of the invention.

FIG. 6 shows variation in total magnetic fluxes between times before and after the reflow soldering, corresponding to variation in the characteristic shown in FIG. 5. A value of variation in thermal demagnetization due to heating at the reflow soldering temperatures is found to be 2.8% in the case of Ml, 5.2% in the case of M2, 11.7% in the case of M3, and 13.5% in the case of M4.

Figure 7:
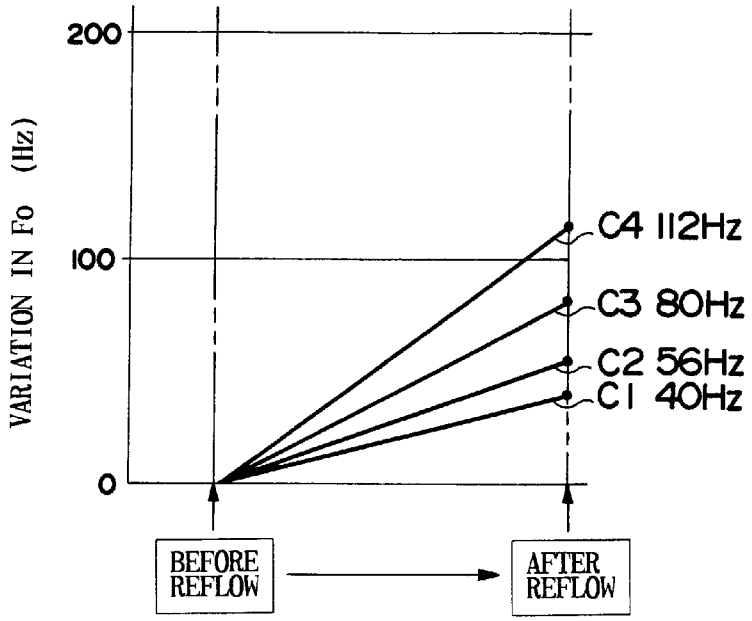
FIG. 7 is a graph showing variation characteristic of the minimum resonance frequency due to variation in an air gap spread before and after the reflow soldering process with respect to the electroacoustic transducer according to other embodiments of the invention.

FIG. 7 shows variation in the minimum resonance frequency Fo of the diaphragm 22 due to variation in the spread of the air gap 24 between times before and after the reflow soldering in the case of changing material grade for the holder member 20. In the figure, such a characteristic is denoted by C1 in the case of forming the holder member 20 by molding LCP- 1, Vectra E 130i at an injection pressure of 40 kg/cm$^3$, by C2 in the case of molding LCP - 2, Vectra E 130i at an injection pressure of 60 kg/cm$^3$, by C3 in the case of using Nylon 6T, Arlen 230, by C4 in the case of using PPS, C - 100HG, and by CO in the case of using brass, respectively. In FIG. 7, a value of variation in the minimum resonance frequency Fo is 40 Hz for C1, 56 Hz for C2, 80 Hz for C3, and 112 Hz for C4, respectively.

Figure 8:
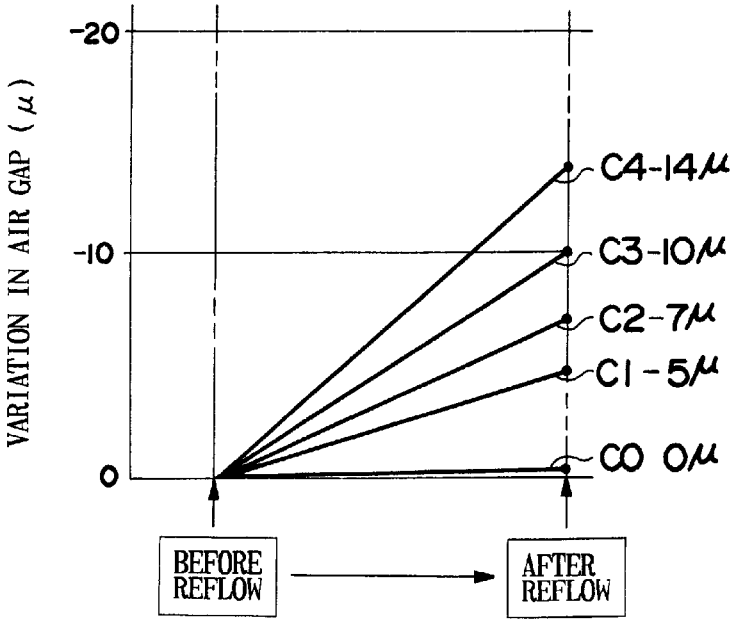
FIG. 8 is a graph showing variation characteristic of the air gap spread before and after the reflow soldering process with respect to the electroacoustic transducer according to the other embodiments of the invention.

As shown in FIG. 8, a value of variation in the spread of the air gap 24 due to heating at the reflow soldering temperatures is found to be 0 $\mu$m in the case of C0, - 5 $\mu$m in the case of C1, - 7 $\mu$m in the case of C2, - 10 $\mu$m in the case of C3, and - 14 $\mu$m in the case of C4. Thus, in the case of the holder member 20 being formed of resin, the values of the spread of the air gap 24 are found to decrease markedly depending on the grade of materials used as opposed to a case of brass being used where no variation occurs.

Figure 9:
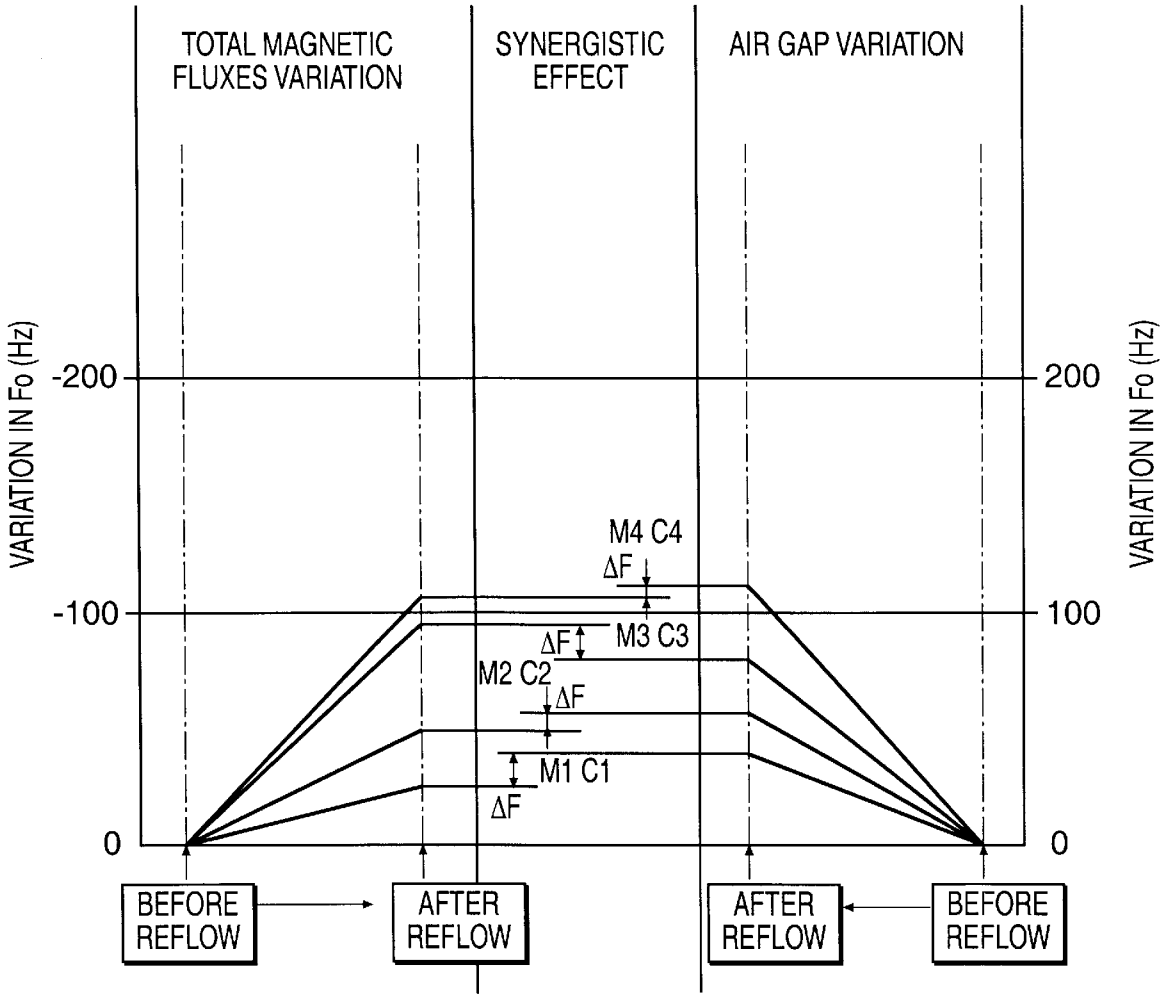
FIG. 9 is a chart showing synergistic effects of variation in the minimum resonance frequency due to variation of the total magnetic fluxes and variation in the minimum resonance frequency due to variation in the air gap spread, before and after the reflow soldering, with respect to the electroacoustic transducer according to the aforesaid embodiments of the invention.

Accordingly, by matching variation in the total magnetic fluxes of the magnet 10 with variation in the spread of the air gap 24, the decrease in the minimum resonance frequency Fo due to demagnetization of the magnet 10 is caused to compensate for the increase in the minimum resonance frequency Fo due to the decrease in the spread of the air gap 24. Synergistic effects of both variations are illustrated in FIG. 9. That is, by matching M1, M2, M3, and M4 with C1, C2, C3, and C4, respectively, the decrease in the minimum resonance frequency Fo due to demagnetization of the magnet 10 cancels out the increase in the minimum resonance frequency Fo due to the decrease in the spread of the air gap 24, compensating for each other. As a result, an increment of variation ΔF in the minimum resonance frequency Fo of the diaphragm 22 is rectified to a minuscule value.

Figure 10:
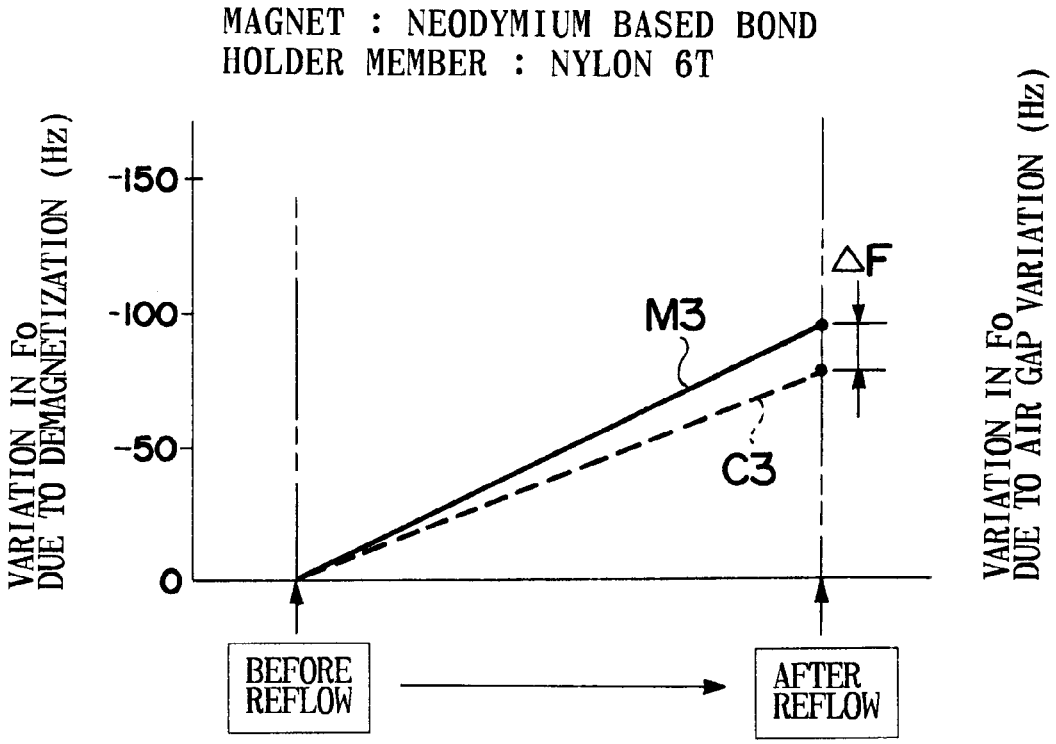
FIG. 10 is a chart showing synergistic effects of variation in the minimum resonance frequency due to valiation of the total magnetic fluxes and variation in the minimum resonance frequency due to variation in the air gap spread, before and after the reflow soldering, with respect to the electroacoustic transducer according to the aforesaid embodiments of the invention.
Figure 11:
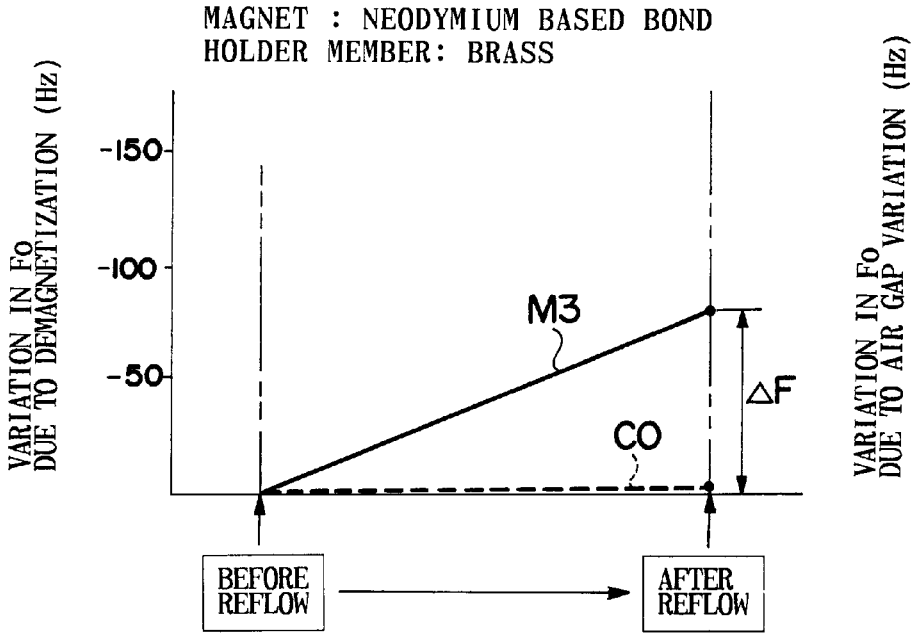
FIG. 11 is a graph showing variation characteristics of the minimum resonance frequency due to variation of the total magnetic fluxes and the minimum resonance frequency due to variation in the air gap spread, before and after the reflow soldering, with respect to conventional electroacoustic transducers.
Figure 12:
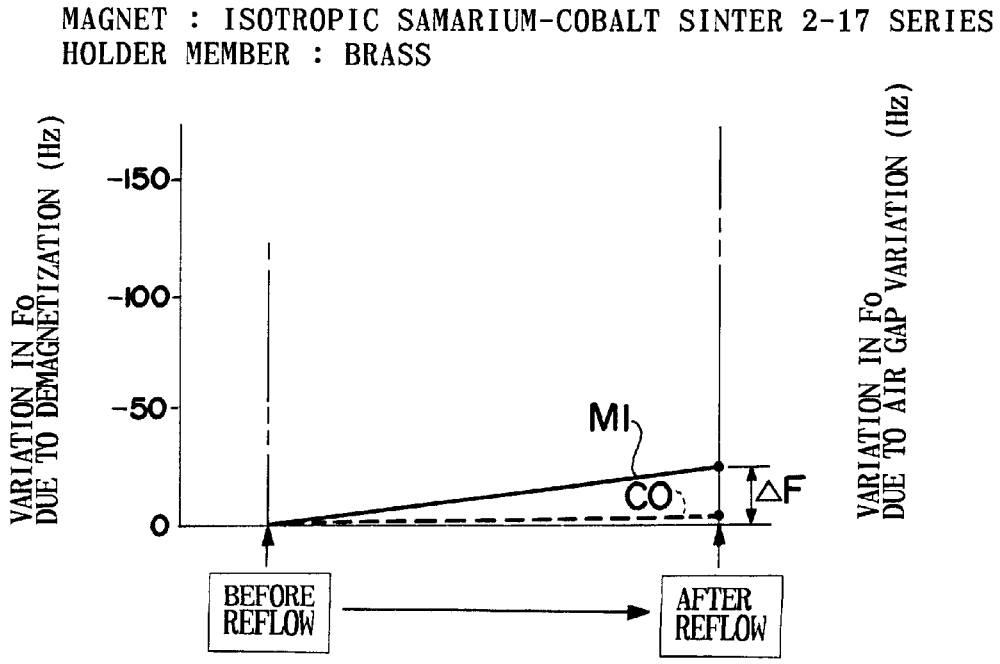
FIG. 12 is a graph showing variation characteristics of the minimum resonance frequency due to variation of the total magnetic fluxes and the minimum resonance frequency due to variation in the air gap spread, before and after the reflow soldering, with respect to other conventional electroacoustic transducers.

As shown in FIG. 10, in the case that, for example, the holder member 20 is formed of Nylon 6T, and the magnet 10 is formed of neodymium based bond, a decrease in the minimum resonance frequency Fo of the diaphragm 22 due to demagnetization of the magnet 10 when subjected to heating caused by the reflow soldering process can be compensated for by an increase in the minimum resonance frequency Fo of the diaphragm 22 due to variation in the spread of the air gap 24 with the result that the increment of variation ΔF in the minimum resonance frequency Fo of the diaphragm 22 is reduced to a minuscule value, smaller than the increment of variation ΔF in the minimum resonance frequency Fo as shown in FIGS. 11 and 12 showing the variation characteristic for a conventional electroacoustic transducer.

Figure 13:
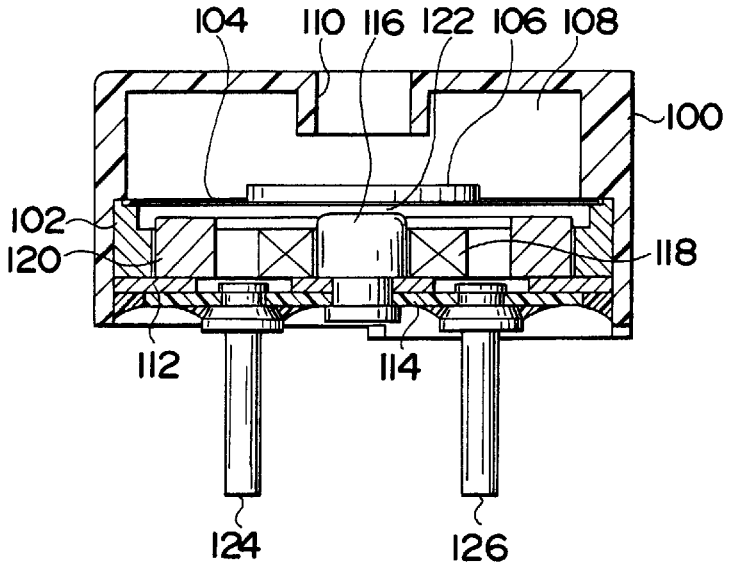
FIG. 13 PRIOR ART
FIG. 13 is a longitudinal sectional view of a conventional electroacoustic transducer.
Figure 14:
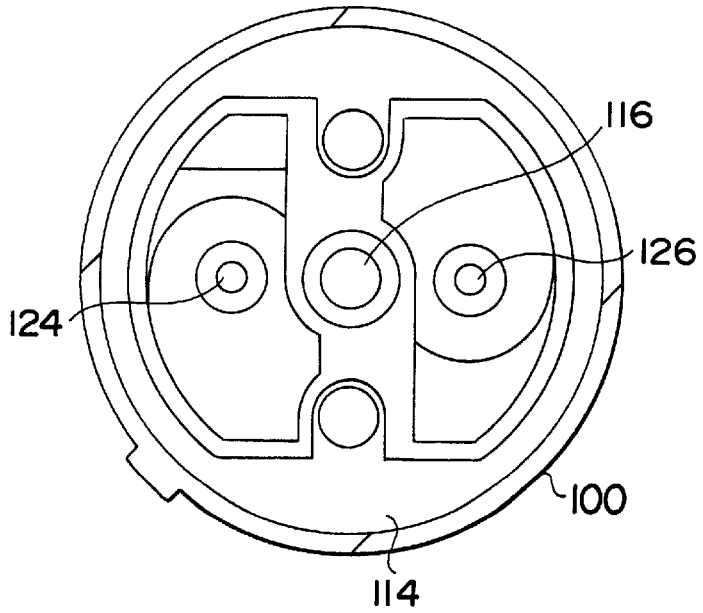
FIG. 14 PRIOR ART
FIG. 14 is a bottom view of the electroacoustic transducer shown in FIG. 13.
Figure 15:
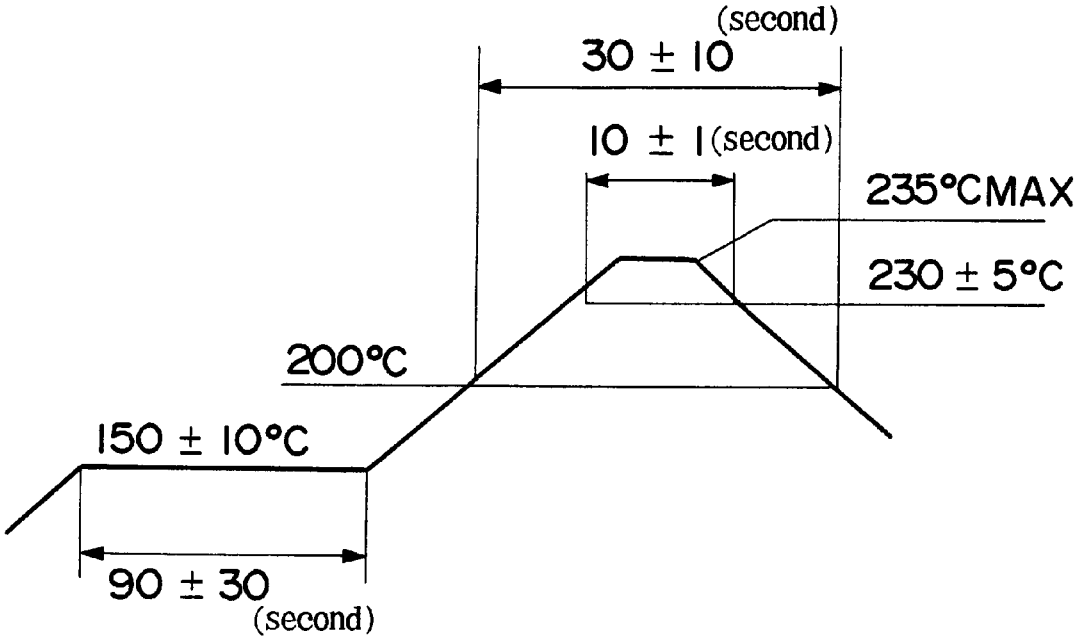
FIG. 15 PRIOR ART
FIG. 15 is a chart showing a profile of the reflow soldering temperatures.
Figure 16:
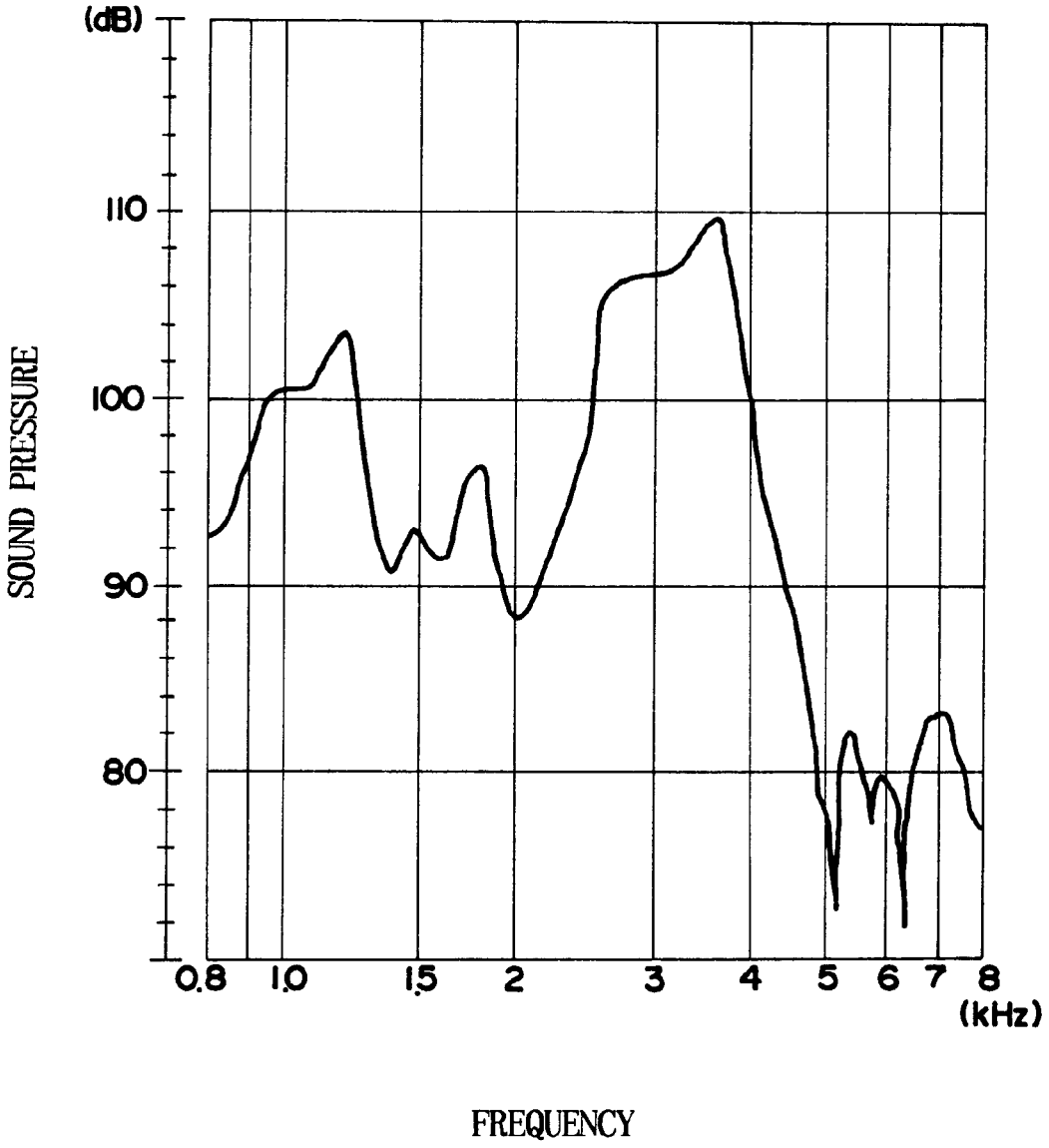
FIG. 16 PRIOR ART
FIG. 16 is a graph showing a frequency characteristic of sound pressure before the reflow soldering process with respect to a conventional electroacoustic transducer.
Figure 17:
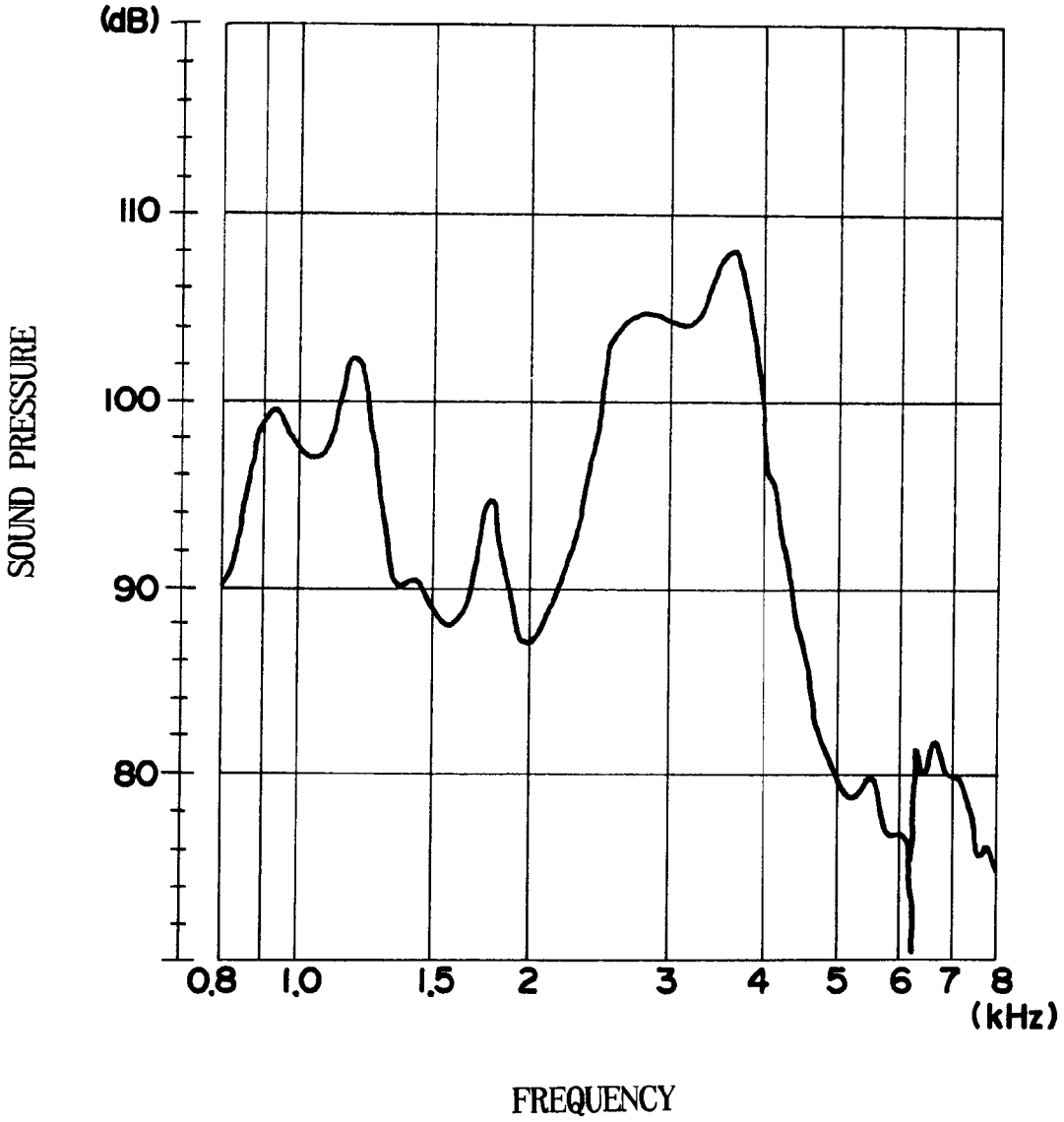
FIG. 17 PRIOR ART
FIG. 17 is a graph showing a frequency characteristic of sound pressure after the reflow soldering process with respect to the conventional electroacoustic transducer.
Figure 18:
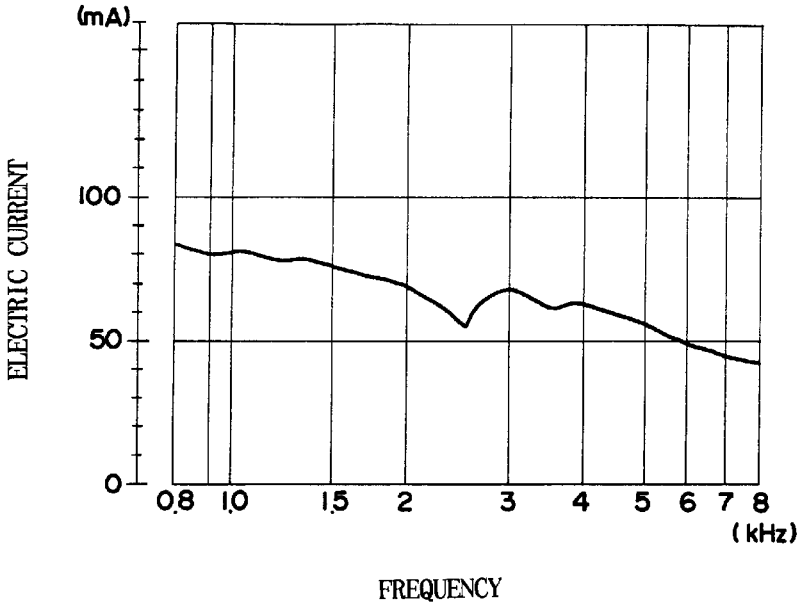
FIG. 18 PRIOR ART
FIG. 18 is a graph showing a frequency characteristic of electric current before the reflow soldering process with respect to a conventional electroacoustic transducer.
Figure 19:
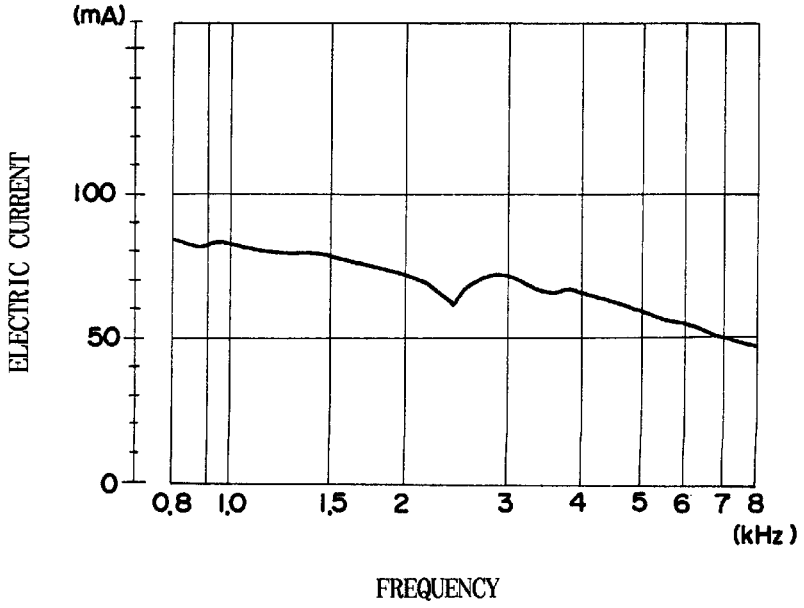
FIG. 19 PRIOR ART
FIG. 19 is a graph showing a frequency characteristic of electric current after the reflow soldering process with respect to the conventional electroacoustic transducer.
Figure 20:
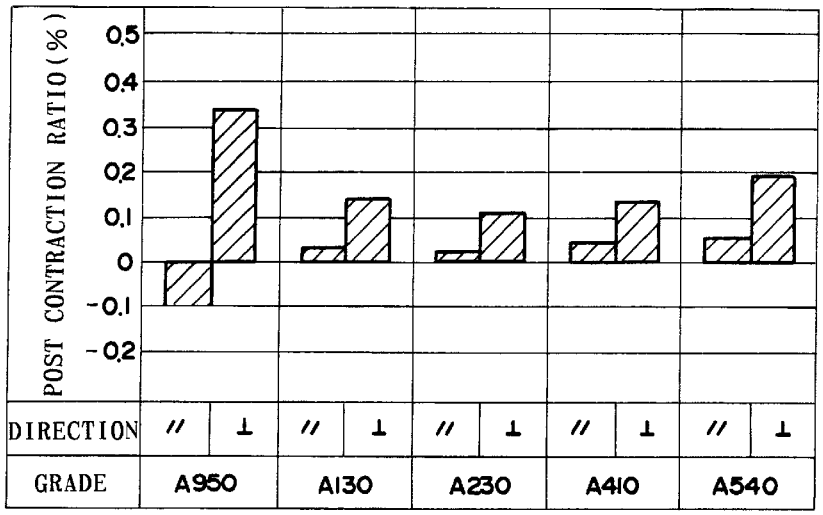
FIG. 20 PRIOR ART
FIG. 20 is a graph showing contraction ratio of the holder member used in a conventional electroacoustic transducer, caused by annealing thereof.
Figure 21:
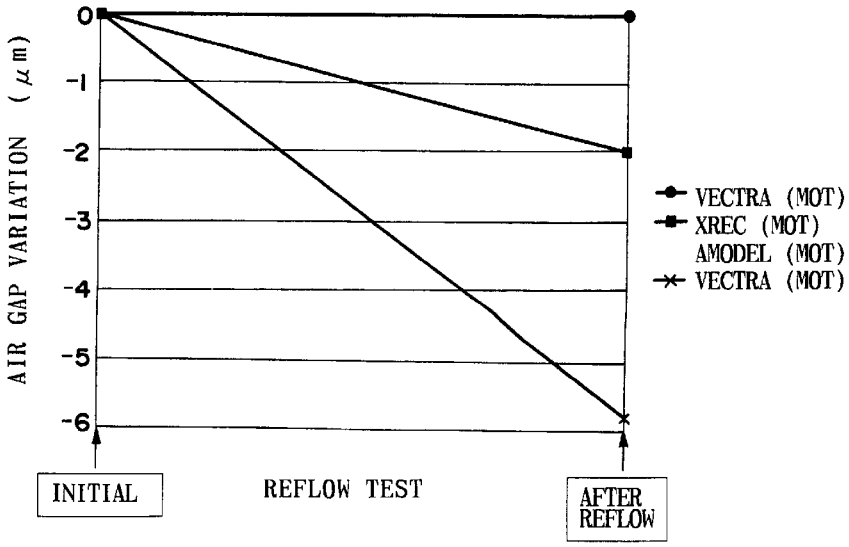
FIG. 21 PRIOR ART
FIG. 21 is a chart showing variation in the air gap of the conventional electroacoustic transducer, after the reflow soldering process.

FIG. 11 shows a variation characteristic of the minimum resonance frequency Fo of the diaphragm 22 in the electroacoustic transducer as illustrated in FIGS. 13 and 14, wherein brass is used for the holder member 20, and a neodymium based bond magnet is used for the magnet 10. M3 denotes variation in the minimum resonance frequency Fo of the diaphragm 22 due to demagnetization of the magnet 10 taking place between times before and after the reflow soldering, and C0 in the minimum resonance frequency Fo of the diaphragm 22 due to variation in the spread of the air gap 24. It is shown that with the electroacoustic transducer constituted as above, an increment of variation ΔF in the minimum resonance frequency Fo becomes greater.

FIG. 12 shows a variation characteristic of the minimum resonance frequency Fo of the diaphragm 22 in the electroacoustic transducer as illustrated in FIGS. 13 and 14, wherein brass is used for the holder member 20, and an isotropic samarium-cobalt sinter 2–17 series magnet is used for the magnet 10. M1 denotes variation in the minimum resonance frequency Fo of the diaphragm 22 due to demagnetization of the magnet 10 taking place between times before and after the reflow soldering, and CO in the minimum resonance frequency Fo of the diaphragm 22 due to variation in the spread of the air gap 24. It is shown that with such a combination of materials, an increment of variation ΔF in the minimum resonance frequency Fo becomes similar to the characteristic as shown in FIG. 10, however, there is a problem of higher costs of materials.

While the preferred embodiment of the invention has been described with reference to specific materials used for the magnet 10 and the holder member 20, and combination of the materials, it is to be understood that the invention is not limited thereto. Accordingly, any materials and any combination of the materials should be considered to be within the scope of the invention as long as the decrease in the minimum resonance frequency Fo due to demagnetization of the magnet 10 is compensated for by the increase in the minimum resonance frequency Fo caused by contraction of the holder member 20.

As described in the foregoing, the effects of the invention are as follows:

a. By matching changes in magnetic attraction accompanied by variation in the spread of the air gap between the diaphragm and the magnetic core due to heating at the reflow soldering temperatures with variation in demagnetization of the magnet so as to compensate for each other, degradation in the acoustic performance of the electroacoustic transducer due to heating at the reflow soldering temperatures can be prevented, stabilizing the acoustic performance thereof.

b. Thermal degradation of the magnet, that is, demagnetization thereof due to heating at the reflow soldering temperatures can be compensated for by changes in magnetic attraction accompanied by variation in the spread of the air gap between the diaphragm and the magnetic core due to thermal contraction of the holder member so that stable and optimum acoustic characteristic of the electroacoustic transducer is ensured when heated for the reflow soldering process.

c. Since there is no need of restraining variations such as demagnetization of the magnet, thermal contraction of the holder member, and the like, due to heating at the reflow soldering temperatures, inexpensive materials can be used, contributing to reduction of manufacturing costs.

While the preferred embodiment of the invention has been described with respect to its constitution, operation and effects, it is to be understood that the electroacoustic transducer according to the invention is not limited to the embodiment and examples described. Accordingly, any and all modifications, variations, constitutions, or the equivalent which may occur to those skilled in the art from the objects and embodiments of the invention should be considered to be within the scope of the invention.

What is claimed is:

1. An electroacoustic transducer mounted on an electronic equipment by using reflow soldering, the transducer comprising:

a magnetic core;

a coil wound around the core;

a diaphragm vibrated when subjected to an alternating magnetic field produced by the magnetic core;

a holder member supporting the diaphragm such that an air gap is provided between the diaphragm and the magnetic core, the holder member formed of a material that contracts by a predetermined amount due to temperatures of the reflow soldering; and a magnet provided inside the holder member for causing a fixed magnetic field to act on the diaphragm so that electric signals supplied to the coil are converted into sound by converting the electric signals into the alternating magnetic field which is caused to act on the diaphragm, the magnet being formed of a magnetic material causing irreversible demagnetization by temperatures of the reflow soldering;

the effect of the contraction precisely offsetting the effect of the demagnetization to stabilize the acoustic properties of the transducer before and after reflow soldering.

2. An electroacoustic transducer according to claim 1, wherein the magnet is formed of a samarium—cobalt based magnet.

3. An electroacoustic transducer according to claim 1, wherein the holder member is formed of a synthetic resin.

4. An electroacoustic transducer according to claim 1, wherein the temperatures for the reflow soldering process are in the range of 200 to 250° C.

5. An electroacoustic transducer according to claim 1, wherein the magnet is formed of a neodymium based magnet.

6. A method of manufacturing an electroacoustic transducer comprising the steps:

winding a coil around a magnetic core;

positioning a holder member in spaced axial relation to the magnetic core;

locating a diaphragm in the holder member to create an air gap between the diaphragm and the magnetic core, the diaphragm vibrating when subjected to an alternating magnetic field flowing through the magnetic core;

locating a magnet inside the holder member for causing a fixed magnetic field to act on the diaphragm so that electric signals supplied to the coil are converted into sound by converting the electric signals into the alternating magnetic field which acts upon the diaphragm;

subjecting the transducer to reflow soldering wherein the magnet undergoes irreversible demagnetization by temperatures of the reflow soldering while the holder member contracts by a precisely predetermined amount due to the temperatures of the reflow soldering thereby resulting in precisely offsetting effects from contraction and demagnetization that result in a stable acoustic transducer output.

7. The method set forth in claim 6 wherein contraction of the holder member results in a corresponding variation in the air gap between the diaphragm and the magnetic core.

8. An electroacoustic transducer according to claim 6, wherein the magnet is formed of a samarium—cobalt based magnetic material.

9. An electroacoustic transducer according to claim 6, wherein the magnet is formed of a neodymium based magnetic material.

10. An electroacoustic transducer according to claim 6, wherein the holder member is formed of a synthetic resin.

11. An electroacoustic transducer according to claim 6, wherein the temperatures for the reflow soldering process are in the range of 200 to 250° C.

* * * * *